US010731795B2

(12) United States Patent
Sinatov

(10) Patent No.: US 10,731,795 B2
(45) Date of Patent: Aug. 4, 2020

(54) METHOD FOR LIQUID AIR AND GAS ENERGY STORAGE

(71) Applicant: Stanislav Sinatov, Kiryat-Ono (IL)

(72) Inventor: Stanislav Sinatov, Kiryat-Ono (IL)

( * ) Notice: Subject to any disclaimer, the term of this patent is extended or adjusted under 35 U.S.C. 154(b) by 189 days.

(21) Appl. No.: 16/114,240

(22) Filed: Aug. 28, 2018

(65) Prior Publication Data

US 2019/0063685 A1 Feb. 28, 2019

Related U.S. Application Data

(60) Provisional application No. 62/550,707, filed on Aug. 28, 2017.

(51) Int. Cl.
*F17C 9/04* (2006.01)
*F25J 1/00* (2006.01)
(Continued)

(52) U.S. Cl.
CPC ..... *F17C 9/04* (2013.01); *F01K 23/10* (2013.01); *F25J 1/004* (2013.01); *F25J 1/0012* (2013.01);
(Continued)

(58) Field of Classification Search
CPC ..... F17C 9/04; F17C 2221/033; F17C 2223/0161; F17C 2227/0135; F17C 2227/0157; F17C 2227/0365; F17C 2265/05; F17C 2270/0113; F17C 2270/0581; F17C 7/02; F01K 23/10; F01K 1/04; F01K 25/06; F01K 25/14; F25J 1/0012; F25J 1/0022; F25J 1/004; F25J 1/0045; F25J 1/0222; F25J 1/0224; F25J 1/0251; F25J 1/0297; F25J 2220/40; F25J 2230/40; F25J 2230/04; F25J 2260/02; F25J 2260/60; F25J 1/0082; F25J 1/0236; F25J 1/0037; F25J 1/0042; F25J 1/0052; F25J 1/0202; F25J 1/0221; F25J 1/023; F25J 1/0232; F25J 2205/02; F25J 2210/06; F25J 2210/40; F25J 2210/60; F25J 2220/66; F25J 2220/68; F25J 2230/30; F25J 2270/06; F25J 2270/14; F02C 6/16; F02C 1/04; F16T 1/00; Y02E 60/15; Y02E 50/346; C07C 9/04
(Continued)

(56) References Cited

U.S. PATENT DOCUMENTS 3,645,106 A * 2/1972 Gaumer, Jr. ..... F25J 1/0055 62/612
3,657,898 A * 4/1972 Ness ..... F25J 3/04381 62/87
(Continued)

*Primary Examiner* — Justin M Jonaitis

(57) ABSTRACT

A method for liquid air and gas energy storage (LAGES) which integrates the processes of liquid air energy storage (LAES) and regasification of liquefied natural gas (LNG) at the Floating Storage, Regasification and Power (FSRP) facilities through the exchange of thermal energy between the streams of air and natural gas (NG) in their gaseous and liquid states and includes recovering a compression heat from air liquefier and low-grade waste heat of power train for LNG regasification with use of an intermediate heat carrier between the air and LNG streams and utilizing a cold thermal energy of liquid air being regasified for increase in LAGES operation efficiency through using a semi-closed $CO_2$ bottoming cycle.

3 Claims, 3 Drawing Sheets

(51) Int. Cl.
*F25J 1/02* (2006.01)
*F01K 23/10* (2006.01)

(52) U.S. Cl.
CPC ..... *F25J 1/0022* (2013.01); *F25J 1/0045* (2013.01); *F25J 1/0222* (2013.01); *F25J 1/0224* (2013.01); *F25J 1/0251* (2013.01); *F25J 1/0297* (2013.01); *F17C 2221/033* (2013.01); *F17C 2223/0161* (2013.01); *F17C 2227/0135* (2013.01); *F17C 2227/0157* (2013.01); *F17C 2227/0365* (2013.01); *F17C 2265/05* (2013.01); *F17C 2270/0113* (2013.01); *F17C 2270/0581* (2013.01); *F25J 2220/40* (2013.01); *F25J 2230/04* (2013.01); *F25J 2230/40* (2013.01); *F25J 2260/02* (2013.01); *F25J 2260/60* (2013.01)

(58) Field of Classification Search
USPC ..... 62/611, 606, 612, 613, 614, 615, 640, 62/641, 642, 644, 645, 50.2
See application file for complete search history.

(56) References Cited

U.S. PATENT DOCUMENTS 4,012,212 A * 3/1977 Kniel ..... F25J 1/0022 62/621
4,054,433 A * 10/1977 Buffiere ..... F17C 9/04 62/643
4,192,662 A * 3/1980 Ogata ..... F17C 9/04 62/643
4,329,842 A * 5/1982 Hoskinson ..... F02C 3/00 60/39.465
4,357,153 A * 11/1982 Erickson ..... B01D 3/007 203/24
4,437,312 A * 3/1984 Newton ..... F01K 25/06 60/648
4,479,350 A * 10/1984 Newton ..... F01K 25/06 60/648
4,970,867 A * 11/1990 Herron ..... F25J 1/0022 62/613
5,036,671 A * 8/1991 Nelson ..... F25J 1/0022 62/48.2
5,141,543 A * 8/1992 Agrawal ..... F17C 9/04 62/612
6,131,407 A * 10/2000 Wissolik ..... F25J 1/0017 62/606
2003/0101728 A1* 6/2003 Wakana ..... F25J 1/0045 60/727
2009/0293503 A1* 12/2009 Vandor ..... F25J 1/0242 62/45.1
2014/0333139 A1* 11/2014 Vandor ..... F02C 6/16 307/69

* cited by examiner

METHOD FOR LIQUID AIR AND GAS ENERGY STORAGE

CROSS-REFERENCE TO RELATED APPLICATIONS

This application claims the benefits of U.S. Provisional Patent Application No. 62/550,704 titled "Method for Liquid Air and Gas Energy Storage" and filed on Aug. 28 2017.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF INVENTION

The present invention relates to the field of energy storage technologies, and more specifically to the methods enabling an improvement in the technologies intended for large-scale conversion and storage of liquefied natural gas (LNG) fuel and electrical energy. It further relates to the methods making possible to profitably integrate the Liquefied Natural Gas Storage and Re-gasification (LNGSR) and Liquid Air Energy Storage (LAES) technologies, as the first step to creation of a highly efficient Liquid Air and Gas Energy Storage (LAGES) technique. Such method may be preferably used in design of the Floating LNGSR units integrated with the barge-mounted Power Generation units, which are intended for highly efficient operation both in the base-load and load-following modes.

BACKGROUND OF THE INVENTION

A planned and started transfer to the decarbonized power grids is based first of all on increased use of the fossil fuels with reduced carbon content, such as natural gas in gaseous and liquefied states. In the latter case an implication of the LNGSR terminals is constantly growing. As described in "Handbook of Liquefied Natural Gas" (by Saeid Makhatab, et al., Elsevier, Oxford, 2014), they perform the unloading and storage of the imported liquefied natural gas (LNG) and its on-demand pumping, regasification and injection into transmission pipeline. According to report of the LNG-Worldwide Ltd. "Current Outlook for Global LNG to 2020 and European LNG Prospects" (September 2014), in 2013 the 104 existing LNGSR terminals in 29 countries have imported 237 MTPA of LNG fuel, providing at the time approximately 10% of the global gas consumption. Thereby, a volume of imported LNG is expected to grow by 2025 up to 500 MTPA.

Recently the floating storage and regasification units (FSRU) have been introduced in the LNG market. Moreover, the concepts of FSRU integrated with barge-mounted power plants (BMPP) are intensively now developed by the Wison, BWSC, TGE-Marine Gas Engineering, Samsung and Hyundai Heavy Industries and other companies. These near-shore Floating Storage, Regasification and Power production Units (FSRPU) may be the flexible and economic alternative to building the land-based LNG regasification terminals and stationary power plants, since they can avoid the long lead time and high cost of building the land-based facilities and offer quick deployment to a range of potential locations. Being connected to the local land-based electrical and gas networks they may provide the seasonal or intermittent deliveries to smaller and remoted gas and power customers with the significantly reduced CAPEX and OPEX indexes.

The developers of a FSRPU concept claim the benefit of recovering a high-grade waste heat from the power generators installed at the BMPP for regasification of LNG instead of using the air, sea water or intermediate carrier-based LNG evaporators for this purpose. However such technical solution does not make possible to use the mentioned waste heat for increase in fuel efficiency of power generation processes and does not obviate a need for use of the said LNG evaporators during operation of the power generators at low loads. In addition, dissipation of cold thermal energy of the LNG being regasified eliminates a possibility of its profitable use in the integrated energy conversion processes, contrary to proposed, for example, operation of the land-based LNGSR terminal in conjunction with the co-located Liquid Air Energy Storage (LAES) system (see the U.S. patent application Ser. No. 16/109,884). Here a cold thermal energy of LNG converted into cold thermal energy of liquid air is profitably used for reliquefying up to 35% of send-out natural gas during LAES facility discharge. What is more, availability of liquid air as an intermediate product of the LAEStechnology makes possible to gain the other benefits from its harnessing: provision of zero-carbon emitting exhaust of LAES facility through a cryogenic capture of $CO_2$ component (as described in the published U.S. Patent Application No. US 20180221807) or an increase in power output and efficiency of the LAESfacility equipped with the semi-closed $CO_2$ bottoming cycle (as described in the provisional U.S. Patent Application No. 62/554,053).

By this means there is a need for improvement in design of the FSRPU. A basis for such improvement could be an integration between the FSRPU and LAES into floating Liquid Air and Gas Energy Storage (LAGES) and elaboration of such method for its operation which would provide: a) full obviation of the need for usage of the air, sea water or intermediate carrier-based LNG evaporators; b) an effective recovery of high-grade waste heat from power generators for increase in its output and fuel efficiency; c) a further improvement in performance of the LAESsystem through reducing the energy intensity of air liquefaction; and d) widening the applicability of the LAGES system through an efficient its operation both in the load-following regime with energy storage capability and in base-load mode.

SUMMARY OF THE INVENTION

In one or more embodiments, a proposed method for liquid air and gas energy storage (LAGES) may comprise in combination: pumping the LNG stream from the storage tanks into a co-located Liquid Air Energy Storage (LAES) system for continuous regasifying the LNG in the said system including its preheating, evaporation and superheating with injection of send-out gas into gas networks; continuous producing a liquid air with consuming a required power by the compressors of air liquefier of the LAESsystem and interchanging a waste thermal energy between the LNG being regasified and the process air being produced; storing a liquid air only in the periods of low demand for energy in the grid; on-demand producing the on-peak and mid-peak power by at least one power train comprising a fueled and supercharged reciprocating engine-based generator with upstream installed high-pressure air expander and down-stream installed low-pressure exhaust gas expander through consuming both a stored and directly produced liquid air at a rate exceeding a rate of its continuous production; and recovering a cold thermal energy released by regasified liquid air for performing the operation of the LAES system in one of the modes selected from the group comprising: reliquefaction of a part of send-out natural gas, cryogenic capture of $CO_2$ component from exhaust of power train and integration of power train with a semi-closed $CO_2$ bottoming cycle.

In so doing the improvements in method may further comprise in combination: driving the compressors of air liquefier during off-peak hours by at least one reciprocating engine-based generator of the power train through consumption of the fuel and air delivered from atmosphere by a standard turbocharger and required for combustion of said fuel in the said engine; driving the compressors of air liquefier during on-peak and mid-peak hours by at least one said reciprocating engine-based generator of the power train through consumption of a fuel and regasified liquid air produced at that instant by air liquefier and required for combustion of said fuel in the said engine; producing the on-demand power by at least one said power train with its delivery into electrical grid during on-peak and mid-peak hours through consumption of a fuel and liquid air stored and produced at that instant by air liquefier; recovering a part of cold thermal energy inherent in the produced pressurized liquid air in the process of its liquefaction in the air liquefier; and recovering a cold thermal energy of LNG being regasified for cooling a process air at the inlet of compressor stages of air liquefier down to (−60° C.)-(−80° C.) using a closed cooling loop with an intermediate heat carrier between the air and LNG.

For production of liquid air the proposed method may further combine the following processes in air liquefaction (AL) train: pressurizing a feed air stream in the first stage of feed air compressor with its following cooling in the first feed air cooler, drying and freeing from the atmospheric $CO_2$ contaminants and an additional cooling in the second feed air cooler; following pressurizing a feed air stream in the second stage of feed air compressor up to a bottom charge cycle pressure with its following cooling in the third feed air cooler; forming a process air stream as a mixture of the said pressurized and cooled feed air stream and a stream of boil-off air recirculating from the air separator at a bottom charge cycle pressure; following pressurizing the process air stream up to top charge cycle pressure in two-stage process air compressor with its intercooling in the first process air cooler and aftercooling in the second process air cooler; further reducing in temperature of process air in the second air-to-LNG heat exchanger with following its liquefying through a said recovery of a part of cold thermal energy inherent in the produced pressurized liquid air; subsequent reducing a temperature of the liquefied process air in the first air-to-LNG heat exchanger; final cooling the liquefied process air by the recirculating stream of boil-off air escaping the air separator; depressurizing the liquefied process air in the liquid air expander, resulting in formation of deeply cooled two-phase process air escaping the said expander at a bottom charge cycle temperature and a bottom charge cycle pressure; separating the liquid and gaseous phases of process air with a said recirculation of boil-off air stream; pressurizing a liquid air stream escaping a separator up to a low pressure required for its following storage or direct use in the power train; recovering a part of cold thermal energy of low pressure liquid air for the said liquefying a process air; and delivering a low pressure liquid air into a storage or its direct use in the power train for production of on-demand power over the mid-peak and on-peak hours.

In so doing, recovering the cold thermal energy of regasified LNG for cooling a process air at the inlet of compressor stages of air liquefier may be performed through: collection of compression heat by the streams of intermediate heat carrier circulating through a set of the mentioned air coolers installed in parallel at the outlet of heat carrier pump; pooling all said steams at the outlet of coolers; additional heating of a pooled stream of intermediate heat carrier in the main cooler of at least one reciprocating engine with use a low-grade waste heat of said engine; and using a collected heat for regasification and superheating of the LNG stream escaping the second air-to-LNG heat exchanger.

Finally, the proposed method may be applied to storage an excessive energy from the grid through its using for driving the compressors of air liquefier during off-peak hours and said additional heating of a pooled stream of intermediate heat carrier at that instant with an accumulated waste heat of cooling system of at least one reciprocating engine operated during mid and on-peak hours.

BRIEF DESCRIPTION OF THE DRAWINGS

Embodiments will hereinafter be described in detail below with reference to the accompanying drawings, wherein lie reference numerals represent like elements. The accompanying drawings have not necessarily been drawn to scale. Where applicable, some features may not be illustrated to assist in the description of underlying features.

DETAILED DESCRIPTION OF THE INVENTION

The practical realization of the proposed method for liquid air and gas energy storage (LAGES) may be performed through the integration between the LNGSR terminal and LAES system into combined LAGES facility. At such facility the interchanging of a waste thermal energy between the LNG being regasified and the process air being liquefied and regasified provide a drastic increase in performance of the LAES system and a marked decrease in the LAGES capital costs. The invented method may be especially promising for design of the Floating LNGSR units integrated with the barge-mounted Power Generation units, making such integrated facility capable to highly efficient operate both in the base-load and load-following modes.

Figure 1:
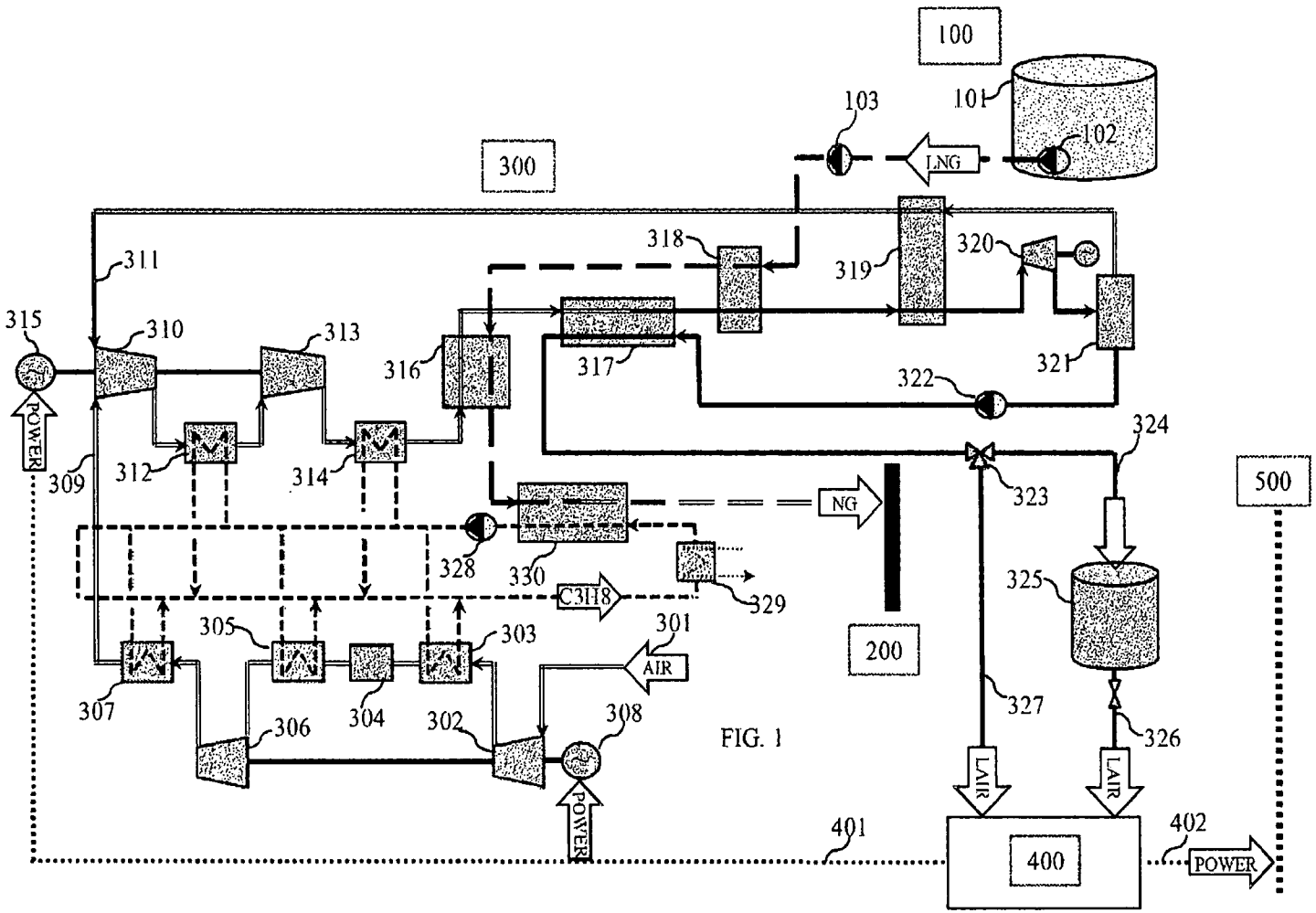
FIG. 1 is a schematic view of the first embodiment of the LAGES facility which may be designed for production of a liquid air in the air liquefier train, according to the invented method.

The FIG. 1 is a schematic view of the air liquefier of the LAGES facility designed for continuous production of liquid air. A power required for driving the compressors of air liquefier is produced by one of the turbocharged reciprocating engine 1 installed in the power block of facility and supplied with fuel 2. During off-peak hours a charging of the gas engine with combustion air is performed by the standard turbocharger 3, whereas during mid and on-peak hours a regasified liquid air 4 delivered from the power block is used for this purpose. In its turn, exhaust gases 5 are directed to power block, wherein their energy is used to perform an additional work.

The LNG stream is continuously delivered from the storage 6 by the LP and HP pumps 7 and 8 into air liquefier of the LAGES facility, wherein it is initially heated in the first air-to-LNG heat exchanger 9 by a stream of highly pressurized liquefied process air and thereafter in the second air-to-LNG heat exchanger 10 by a stream of highly pressurized process air. The further evaporation and final reheating of LNG is going in the LNG regasifier 11 at the expense of heat transfer with an intermediate heat carrier. The regasified LNG is injected into pipeline 12 of gas network.

The atmospheric feed air 13 is pressurized in the first stage 14 of feed air compressor, cooled in the first feed air cooler 15, dried and freed from atmospheric $CO_2$ contaminants in the adsorber 16, additionally cooled in the second feed air cooler 17, pressurized in the second compressor stage 18 up to a bottom charge cycle pressure and aftercooled in the third feed air cooler 19.

At the inlet of process air compressor 20 the pressurized and aftercooled feed air is mixed with the boil-off air 21 recirculating from the air separator at the same bottom charge cycle pressure. The process air, as a mixture of feed and boil-off air streams, is pressurized in the first stage 20 of process air compressor, intercooled in the first process air cooler 21, further pressurized in the second compressor stage 22 up to a top charge cycle pressure and aftercooled in the second process air cooler 23.

Further deep cooling a highly pressurized process air is performed in the said second air-to-LNG heat exchanger 10 by the LNG stream, after which the air is liquefied in the process air liquefier 24 through its cooling by a stream of liquid air escaping the air separator. A temperature of the pressurized liquefied process air is additionally reduced in two heat exchangers installed in tandem: in the said first air-to-LNG heat exchanger 9 by the LNG stream and in the air-to-air heat exchanger 25 by the recirculating stream of boil-off air escaping the air separator. The following depressurizing the liquefied process air in the liquid air expander 26 leads to formation of deeply cooled two-phase process air escaping the said expander at a bottom charge cycle temperature and a bottom charge cycle pressure.

The liquid and boil-off phases of process air are separated in the separator 27 with a said recirculation of boil-off air stream through heat exchanger 25 into inlet of process air compressor 20. In its turn, a pressure of liquid air stream escaping a separator is increased by a pump 28 up to a low value required for its following storage or direct use in the power block, after which this stream is directed to air liquefier 24, wherein a part of its cold thermal energy is used for the said liquefying a process air. The LP liquid air escaping the liquefier 24 is directed through a control valve 29 into a liquid air storage 30 during off-peak hours or to the power block for production of on-demand power over the mid-peak and on-peak hours.

Collection of compression heat and its recovery for LNG regasification is performed with use of intermediate heat carrier circulating in the closed loop and directed by the pump 31 through a set of said air coolers 15, 17, 19, 21 and 23 placed in parallel at the outlet of said pump. To reach a temperature required for injection of regasified LNG into NG network, a pooled stream of the intermediate heat carrier streams escaped the said air coolers is additionally heated in the heat exchanger 32 by a low-grade waste heat extracted from the cooling system of the gas engine 1 being used for driving the compressors of air liquefier. In the said LNG regasifier 11 the collected compression heat of air liquefier and low-grade heat of gas engine cooling system are transferred from an intermediate heat carrier to the LNG, resulting in its regasification and superheating.

The described above mode of air liquefier operation is applied to storage of excessive power produced by the BMPP facility integrated with SRGU. However the invented method may be also adapted to storage of excessive energy in the grid. For this purposes, an excessive power from the grid is consumed during off-peak hours for driving the compressors of air liquefier, whereas a gas engine 1 is taken out of service for this time-period and is put into operation during mid and on-peak hours. A low-grade waste heat of its cooling system is accumulated in this time interval and used in the heat exchanger 32 for an additional heating of the intermediate heat carrier during off-peak hours.

Figure 2:
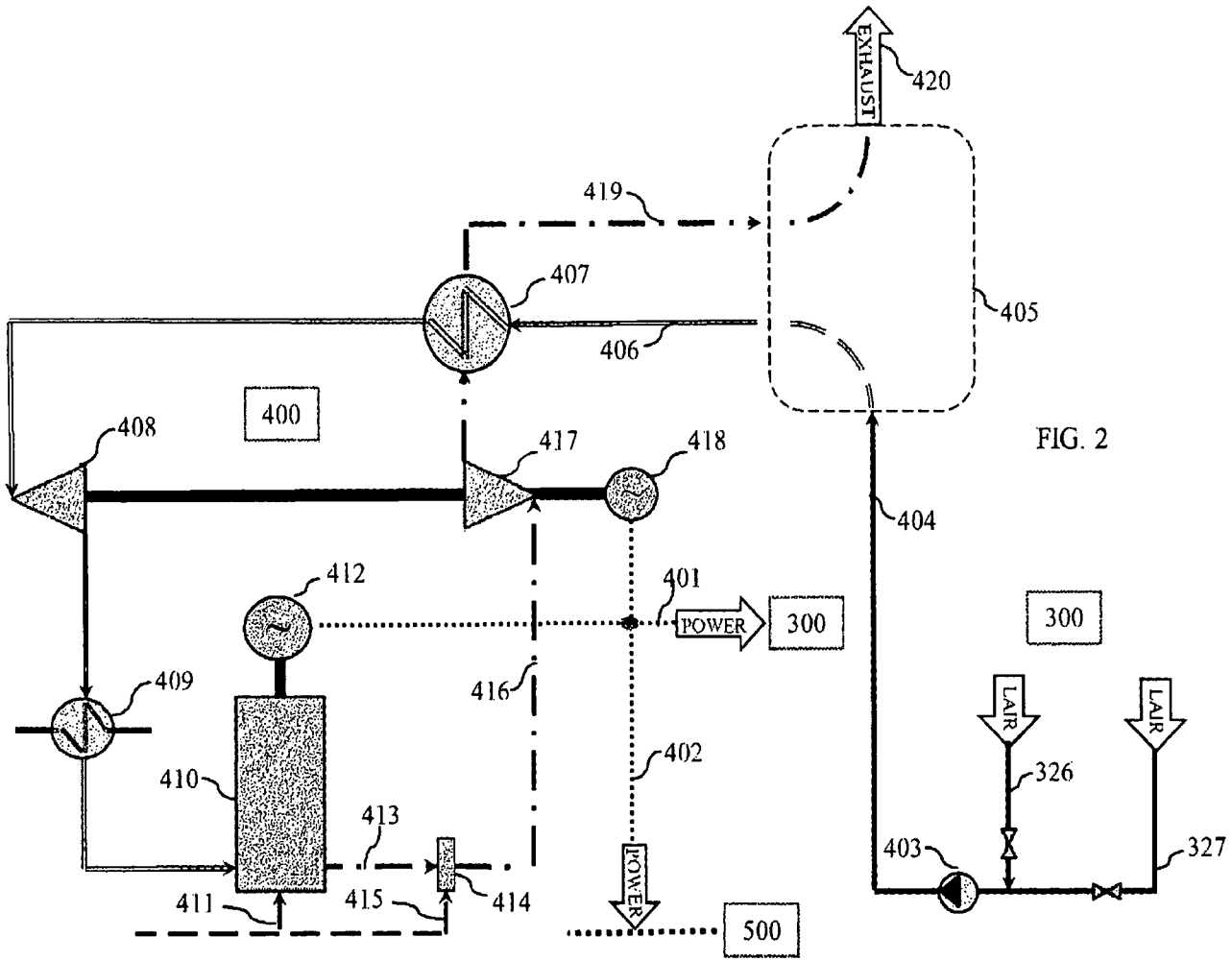
FIG. 2 is a schematic view of the second embodiment of the LAGES facility which may be designed for operation of power block with use of produced liquid air.
Figure 3:
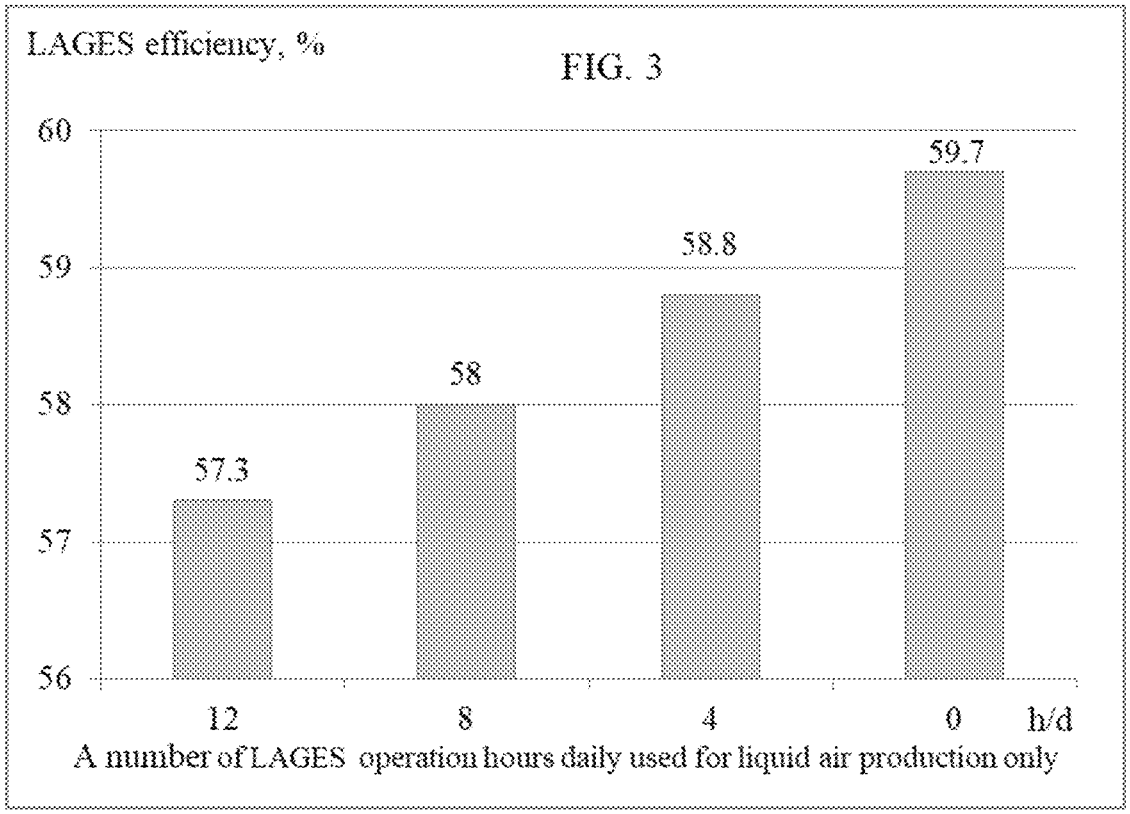
FIG. 3 is a diagram showing a fuel-to-power conversion efficiency of the LAGES facility vs. a number of its operation hours daily used for liquid air production only, according to the invented method.

The improvements in operation of the power block of the LAGES facility are not subject of the present invention. Because of this its schematic view in the FIG. 2 is shown only for illustration of the possible methods for its operation developed and described previously in the U.S. patent application Ser. No. 16/109,884, published U.S. Patent Application No. US 20180221807 and provisional U.S. Patent Application No. 62/554,053. By and large a power block of any LAESfacility comprises a system 33 intended for regasification of discharged liquid air with recovery of its cold thermal energy and one or several power trains intended for harnessing the regasified discharged air in the power generation processes. The designer can select any configuration and method of operation for the system 33 from among the described in the mentioned patent applications using a power train configuration identical for all applications. During mid-peak hours the discharged liquid air is delivered into this system by high-pressure pump 34 directly from air liquefier via pipe 35, whereas during on-peak hours the discharged liquid air stream from the storage 30 is added via pipe 36 to total amount of liquid air consumed by the system 33.

In the FIG. 2 a power block is exemplified by two power trains 37 and 38. Both trains have an identical configuration, making possible to charge their gas engines with combustion air via pipe 4 without use of the turbochargers during on-peak and mid-peak hours. At the same time a gas engine 1 of the train 37 is additionally equipped with a standard turbocharger 3 (see FIG. 1), providing its operation during off-peak hours. The regasified air escaping the system 33 via pipe 39 at the top discharge cycle pressure is delivered into hot recuperator 40, wherein a thermal energy of exhaust gases escaping the train 37 is used for superheating the delivered discharged air. The following expansion of this air in the high-pressure expander 41 leads to reduction in its pressure down to an intermediate level, at which it is delivered into reciprocating engine 1 via pipe 4. Here the delivered air is used for combustion of fuel supplied via pipe 2. The exhaust gases escaping the engine 1 via pipe 5 at the enhanced pressure and temperature are additionally heated in the duct burner 42 and directed to the inlet of low-pressure expander 43. Here their pressure is reduced down to a practically atmospheric level, whereas outlet temperature is high enough for said superheating the regasified air in hot recuperator 40. A total power produced by the HP expander, gas engine and LP expander is delivered into grid during mid-peak and on-peak hours. The exhaust gases are removed to atmosphere via pipe 44 or optionally subjected to cryogenic treatment in the system 33.

INDUSTRIAL APPLICABILITY

The performances of liquid air and gas energy storage (LAGES) facility using the proposed method of operation are tabulated below for the case of a possible send-out capacity of FSRU at a level of ~0.5 MTPA. At such LAGES facility production of a liquid air in the LAESsystem is performed during 24 h per day and on condition that relationship between the flow-rates of LNG (pure methane) and liquid air streams is equal to 1.1:1. The production of power in the LAESsystem may be also performed both in the base-load operation mode during 24 h/d and in the load-following regime. In the las case the durations of off-peak and on-peak hours have been selected identical, but may be varied from 0 to 12 hours per day with operation during rest of daily hours in mid-peak regime. At the duration equal to 0 h/d, the LAGES facility is operated in base-load mode. For each operation mode a sought value of facility fuel-to-power conversion efficiency is determined.

In calculation performed the top charge cycle pressure of process air stream and the top discharge cycle pressure of pumped liquid air stream are set at a level of 67 barA and 140 barA correspondingly. The power block of the LAES-system comprises a set of two power trains with reciprocating gas engines and expanders. The first engine operated continuously is equipped with the standard turbocharger being used only during off-peak hours at ~65% of engine nominal output. The second engine is operated only during on-peak hours. A charging of the reciprocating engines with combustion air is performed at a pressure of ~4 barA, whereas the discharging of exhaust gases is performed at a pressure of ~3.5 barA and a temperature of ~570° C. The mentioned temperature of engine exhaust gases and an amount of fuel combusted in the duct burner of the power train provide the maximum admissible temperatures of ~540° C. and 760° C. for regasified air at the inlets of the modified steam turbine being used as HP expander and power turbine being used as LP expander. The general data of equipment installed in the Air Liquefier (AL) train and Power Production (PP) train are listed in Table 1.

For regasification of discharged liquid air with recovery of its cold thermal energy a system providing integration of the power trains with the semi-closed $CO_2$ bottoming cycle has been selected, because such system makes possible to reach a highest level of fuel efficiency of the LAGES facility. As an intermediate heat carrier in the air liquefier the propane has been selected. The main results of performed calculations are presented in the Tables 2.-4 They have clearly demonstrated a very high daily fuel efficiency of the LAGES facility which is equal to 59.7% during facility operation in base-load regime and 57.3-58.8% during its operation in load-following regime with storage of excessive power produced by facility.

TABLE 1

| POWER CONSUMED by AL TRAIN | | | POWER PRODUCED by 1 PP TRAIN | | |
|---|---|---|---|---|---|
| LP Feed air compressor | kWe | 1,176 | Gas engine | kWe | 9,730 |
| HP Feed air compressor | kWe | 1,486 | LP exhaust expander | kWe | 4,579 |
| LP Main air compressor | kWe | 1,796 | HP air/CO2 expander | kWe | 8,597 |
| HP Main air compressor | kWe | 1,957 | HP liquid air pump | kWe | −357 |
| Liquid air expander | kWe | −122 | Bypass mix expander | kWe | 38 |
| LP Liquid air pump | kWe | 15 | CO2 liquid pump | kWe | −63 |
| Propane pump | kWe | 12 | Total discharge power | kWe | 22,524 |
| Total charge power | kWe | 6,319 | | | |
| **GAS ENGINE and DUCT BURNER DATA** | | | **LNG REGASIFIED & AIR LIQUEFID DATA** | | |
| Type of prime mover | GE | Gas engine | LNG mass flow-rate | kg/s | 16.5 |
| | | | NG send-out pressure | bara | 80 |
| GE charge air flow-rate | kg/s | 15.1 | NG send-out temperature | ° C. | 10 |
| GE charge air pressure | barA | 3.9 | LAIR mass flow-rate | kg/s | 15.1 |
| GE nominal power | kWe | 9,730 | LAIR storage pressure | barA | 12 |
| Efficiency at 100% SMCR | % | 46.3 | LAIR high pressure | barA | 140 |
| Heat input with fuel in GE | kWth | 21,015 | Propane low temperature | ° C. | −74 |
| Heat input with fuel in DB | kWth | 3,618 | Propane high temperature | ° C. | 29 |
| Total heat input | kWth | 24,633 | | | |

TABLE 2

| Parameters | Unit | Alternative 1 | Alternative 2 | |
|---|---|---|---|---|
| Facility operation mode | | Base-load | Load-following | |
| Facility train in operation | | AL + PP | AL | AL + PP |
| Duration | h/d | 24 | 12 | 12 |
| Load of GE with cold TCH | SMCR | 1 × 100% | | 2 × 100% |
| Load of GE with standard TCH | SMCR | | 1 × 65% | |
| Total power produced | MWe | 22.5 | | 45.0 |
| Power self-consumed | MWe | 6.3 | 6.3 | 6.3 |
| Power delivered to grid | MWe | 16.2 | | 38.7 |
| Heat input with fuel | MWth | 27.1 | 13.4 | 54.2 |
| Plant fuel efficiency | % | 59.7 | 57.3 | |

TABLE 3

| Parameters | Unit | Alternative 3 | | |
|---|---|---|---|---|
| Facility operation mode | | Load-following | | |
| Facility train in operation | | AL | AL + PP | |
| Duration | h/d | 8 | 8 | 8 |
| Load of GE with cold TCH | SMCR | | 1 × 100% | 2 × 100% |
| Load of GE with standard TCH | SMCR | 1 × 65% | | |
| Total power produced | MWe | | 22.5 | 45.0 |
| Power self-consumed | MWe | 6.3 | 6.3 | 6.3 |
| Power delivered to grid | MWe | | 16.2 | 38.7 |
| Heat input with fuel | MWth | 13.4 | 27.1 | 54.2 |
| Plant fuel efficiency | % | | 58.0 | |

TABLE 4

| Parameters | Unit | Alternative 4 | | |
|---|---|---|---|---|
| Facility operation mode | | Load-following | | |
| Facility train in operation | | AL | AL + PP | |
| Duration | h/d | 4 | 16 | 4 |
| Load of GE with cold TCH | SMCR | | 1 × 100% | 2 × 100% |
| Load of GE with standard TCH | SMCR | 1 × 65% | | |
| Total power produced | MWe | | 22.5 | 45.0 |
| Power self-consumed | MWe | 6.3 | 6.3 | 6.3 |
| Power delivered to grid | MWe | | 16.2 | 38.7 |
| Heat input with fuel | MWth | 13.4 | 27.1 | 54.2 |
| Plant fuel efficiency | % | | 58.8 | |

It should be noted that the term "comprising" does not exclude other elements or steps and "a" or "an" do not exclude a plurality. It should also be noted that reference signs in the claims should not apparent to one of skill in the art that many changes and modifications can be effected to the above embodiments while remaining within the spirit and scope of the present invention. For example, the invented method may be applied to design and operation of the near-shore Floating Storage, Regasification and Power Units (FSRPU) connected with the national electric and natural gas networks and intended for storage of excessive grid power.

What is claimed as new is:

1. A method for a liquid air and gas energy storage (LACES) comprising in combination:

pumping a liquefied natural gas (LNG) from an LNG storage tank of an LNG terminal into a co-located liquid air energy storage (LAES) facility and continuous re-gasifying the LNG in said LAES facility, resulting in injection of a formed send-out natural gas (NG) into gas networks;

continuous consuming a required power by an air liquefier of the LAES facility and interchanging a waste thermal energy between a re-gasified LNG and a compressed air in said air liquefier, resulting in round-the-clock producing of a low-pressure (LP) liquid air from a part of said compressed air;

storing at least a part of the LP liquid air from the air liquefier only in the off-peak hours in an electric grid;

consuming a fuel and the LP liquid air for producing an on-demand power by a power train comprising at least one fueled and supercharged reciprocating gas engine integrated with an upstream installed high-pressure (HP) air expander and a down-stream installed low-pressure (LP) exhaust gas expander;

recovering a cold thermal energy of a re-gasified liquid air for operating the LAES facility in one of the modes selected from a group comprising: re-liquefaction of a part of the send-out NG, cryogenic capture of a $CO_2$ component from an exhaust of the power train and integration of the power train with a semi-closed $CO_2$ bottoming cycle; and wherein the improvement comprises in combination:

using at least a part of the on-demand power produced by the power train for supplying the air liquefier with the required power in the off-peak hours;

using a part of the on-demand power produced by the power train for supplying the air liquefier with the required power in the on-peak and mid-peak hours;

delivering a rest of the on-demand power produced by the power train to the electric grid;

recovering a part of a cold thermal energy of the LP liquid air for a liquefaction of a process air in the air liquefier at a top charge cycle pressure; and recovering a cold thermal energy of a re-gasified LNG for cooling the compressed air in the air liquefier using a closed cooling loop with an intermediate cold carrier between the LNG and the compressed air.

2. The method as in claim 1, wherein production of the LP liquid air further combines the following processes in said air liquefier:

pressurizing a feed air up to a bottom charge cycle pressure in a two-stage stage feed air compressor with cleaning the feed air from the atmospheric $CO_2$ and $H_2O$ components between the stages of said feed air compressor and cooling the feed air, as the compressed air, by the intermediate cold carrier after each stage of the feed air compressor;

forming a stream of the process air at the bottom charge cycle pressure as a mixture of the feed air and a recirculating air from a liquid air separator of the air liquefier;

pressurizing the process air up to a top charge cycle pressure in a two-stage process air compressor with cooling the process air, as the compressed air, by the intermediate cold carrier after each stage of said process air compressor;

cooling the process air in a second heat exchanger by the LNG from a first heat exchanger and subsequent said liquefaction of the process air at the top charge cycle pressure through recovering a part of the cold thermal energy of the LP liquid air;

further cooling a liquid process air in the first heat exchanger by the LNG from the LNG storage tank;

final cooling the liquid process air by the recirculating air from the liquid air separator;

depressurizing the liquid process air in a liquid air expander, resulting in formation of a deeply cooled two-phase process air at a bottom charge cycle temperature and the bottom charge cycle pressure;

separating said deeply cooled two-phase process air in the liquid air separator, resulting in formation of the outgoing streams of a liquid air and the recirculating air at the bottom charge cycle pressure;

pressurizing the liquid air from the liquid air separator up to the LP and recovering a part of the cold thermal energy of the LP liquid air for said liquefaction of the process air;

delivering the LP liquid air in the off-peak hours from the air liquefier both into a storage tank and into the power train of the LASS facility; and delivering the LP liquid air both from the air liquefier and from the storage tank into the power train of the LAES facility in the on-peak and mid-peak hours.

3. The method as in claim 2, wherein cooling the compressed air in the air liquefier comprises the following processes:

using a compressed air cooler installed after each stage of the feed and process air compressors as a device for transferring a compression heat from the compressed air to the intermediate cold carrier;

collecting the compression heat by the streams of the intermediate cold carrier passing through a set of said compressed air coolers installed in parallel at the outlet of an intermediate cold carrier pump;

pooling all said steams of the intermediate cold carrier at the outlet of the compressed air coolers, resulting in forming the closed cooling loop;

collecting a low-grade waste heat of at least one fueled and supercharged reciprocating gas engine by a pooled stream of the intermediate cold carrier passing through a main cooler of the said gas engine; and re-gasifying the LNG from the second heat exchanger through recovering a heat collected by the intermediate cold carrier in the compressed air coolers and the main cooler of the gas engine.

* * * * *